US010220404B2

(12) United States Patent
Rose et al.

(10) Patent No.: US 10,220,404 B2
(45) Date of Patent: Mar. 5, 2019

(54) HOLSTER FOR SPRAY GUN

(71) Applicants: Robert J. Rose, Richmond, VA (US); Steven E. Adams, Richmond, VA (US); Andrew T. Sinclair, Richmond, VA (US)

(72) Inventors: Robert J. Rose, Richmond, VA (US); Steven E. Adams, Richmond, VA (US); Andrew T. Sinclair, Richmond, VA (US)

(73) Assignee: Worthen Industries, Nashua, NH (US)

( * ) Notice: Subject to any disclaimer, the term of this patent is extended or adjusted under 35 U.S.C. 154(b) by 395 days.

(21) Appl. No.: 15/013,162

(22) Filed: Feb. 2, 2016

(65) Prior Publication Data

US 2016/0221020 A1 Aug. 4, 2016

Related U.S. Application Data

(60) Provisional application No. 62/111,463, filed on Feb. 3, 2015.

(51) Int. Cl.

| | |
|---|---|
| ***B05B 15/62*** | (2018.01) |
| ***B05B 15/00*** | (2018.01) |
| ***B05B 15/52*** | (2018.01) |
| ***B05B 9/01*** | (2006.01) |
| ***B05B 15/50*** | (2018.01) |
| ***B05B 12/00*** | (2018.01) |
| ***B05B 15/55*** | (2018.01) |
| ***B05B 7/02*** | (2006.01) |

(52) U.S. Cl.

CPC ..... *B05B 15/62* (2018.02); *B05B 7/02* (2013.01); *B05B 9/01* (2013.01); *B05B 12/002* (2013.01); *B05B 15/00* (2013.01); *B05B 15/50* (2018.02); *B05B 15/52* (2018.02); *B05B 15/55* (2018.02)

(58) Field of Classification Search

CPC .. B05B 15/62; B05B 7/02; B05B 9/01; B05B 12/002; B05B 15/00; B05B 15/02; B05B 15/0208; B05B 15/55; B05B 15/50; B05B 15/52

USPC ..... 239/104, 106, 525, 526, 289, 273, 282, 239/283; 222/148, 145.2

See application file for complete search history.

(56) References Cited

U.S. PATENT DOCUMENTS

| | | | | |
|---|---|---|---|---|
| 4,426,023 | A * | 1/1984 | Sperry | B05B 7/0408 222/132 |
| 4,746,063 | A * | 5/1988 | Roberts | B05B 15/555 239/1 |
| 5,344,074 | A * | 9/1994 | Spriggs | B01F 5/0403 239/10 |
| 2007/0125407 | A1* | 6/2007 | Chen | B08B 7/02 134/166 R |
| 2016/0031695 | A1* | 2/2016 | Hecht | A61L 2/10 422/24 |

* cited by examiner

*Primary Examiner* — Steven J Ganey

(74) *Attorney, Agent, or Firm* — Lambert Shortell & Connaughton; Gary E. Lambert; David J. Connaughton, Jr.

(57) ABSTRACT

A holster for a spray gun is provided. The holster is configured to hold a spray gun in place when not in use. The holster has a reservoir body that defines an open-topped chamber. A fluid may be held inside the chamber, and a nozzle of the spray gun held by the holster may submerge in this fluid. The nozzle being submerged in the fluid of the holster can prevent hardening, thickening or drying of any material left over on or in the spray gun nozzle after use.

19 Claims, 4 Drawing Sheets

HOLSTER FOR SPRAY GUN

BACKGROUND OF THE INVENTION

Field of the Invention

The present invention relates generally to spray gun components. More particularly the present invention relates to a holster for storing a spray gun, the holster having a fluid reservoir in which the nozzle of the spray gun may rest to prevent clogging of the nozzle.

Description of Related Art

Airless adhesive spray guns are innovative devices that allow the spraying of adhesive without the "fog" overspray caused by the use of air-atomized spray guns. Airless spray guns result in far less fog, saving on total adhesive use. Further, these devices provide a safer, cleaner work environment. Further, the use of airless sprayed adhesive unexpectedly provides better adhesion as well.

Such spray guns operate by atomizing adhesive through a nozzle. Because of the shearing and other forces applied to the adhesive passing through the nozzle, the nozzle can easily and quickly become fouled with use. This fouling causes it to lose effectiveness and eventually clog. Clogging and general fouling is especially noticeable when use is stopped. This includes, for example, taking a break to re-fill an adhesive source, during rest, while replacing material to be sprayed with the adhesive, during lunch breaks, and at the end of the work day, among other times. The time off of use allows the adhesive left in and on the spray nozzle to harden and clog or otherwise interfere with flow through the nozzle. Typically, this clogging/fouling problem is addressed by manually scraping or otherwise removing the hardened adhesive.

Therefore, what is needed is a system that may limit adhesive buildup on the nozzle of the airless adhesive spray gun.

SUMMARY OF THE INVENTION

The subject matter of this application may involve, in some cases, interrelated products, alternative solutions to a particular problem, and/or a plurality of different uses of a single system or article.

In one aspect, a holster for holding a spray gun is provided. The holster is formed of a reservoir body. The reservoir body defines a chamber in which at least a portion of the spray gun can be received. This chamber is configured to be substantially fluid-tight to hold fluid within it without leakage. Two uprights may extend upward from a front face of the reservoir body. These uprights may serve to stabilize the spray gun when held in the holster. Further, a cross bar may extend from a rear of the reservoir body. The cross bar is configured such that a hook of the spray gun can be hooked to the cross bar. A connecting structure such as a flange may extend from the reservoir body to allow the holster to be connected to a wall or other support.

In another aspect, a spray gun holster system is provided. The holster system has a reservoir body. The reservoir body defines a chamber in which at least a portion of the spray gun can be received. This chamber is configured to be substantially fluid-tight to hold fluid within it without leakage. A connecting structure such as a flange may extend from the reservoir body to allow the holster to be connected to a wall or other support. An airless adhesive spray gun is positioned to be resting in the chamber, with at least a nozzle positioned within the chamber. Also within the chamber is a quantity of fluid, in which a nozzle of the spray gun is submerged.

DETAILED DESCRIPTION

Figure 2:
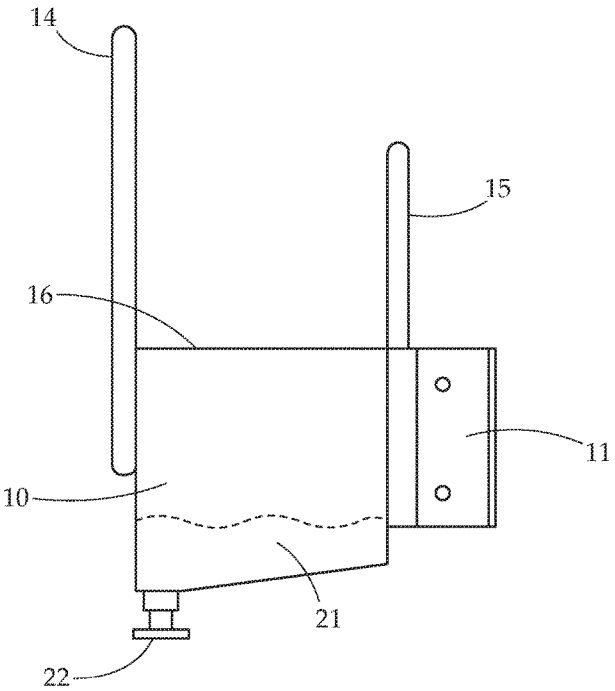
FIG. 2 provides a side cut away view of another embodiment of the holster.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a holster for a spray gun. The holster may have a reservoir forming a cavity in which a forward portion of a spray gun, including the nozzle, may be placed. Fluid may be within the reservoir cavity to prevent a clogging and drying of adhesive or other chemicals on the nozzle of the spray gun.

The present invention provides a holster for an adhesive spray gun. Most embodiments of the holster may be designed for airless atomized adhesive spray guns, but the holster may also be used for air atomized adhesive spray guns, or indeed any fluid spray guns, in varying embodiments. The holster includes a reservoir having a liquid therein to prevent a drying of the adhesive (or other material sprayed through the nozzle) leftover in and on the nozzle. This liquid in the reservoir chamber may also help remove and/or dissolve adhesive on the nozzle. This reservoir may have a single chamber for a one-component or multi-component gun, or may have more than one chamber for a multi-component gun. For example, for a two-component spray gun (having two separate spray nozzles) there may be two chambers in the holster reservoir body.

In one embodiment, each chamber may be separated from the other and may contain a liquid placed therein. In another embodiment, the chambers may be separate from each other but for an opening in the separator allowing fluid interchange between the two chambers. In one embodiment, the liquid may be the same in each chamber. In another embodiment, the liquid may be different and may be specific to the material of the nozzle of the multi-component spray gun (that is to say, the material that is sprayed through each nozzle). The specific fluid placed in each chamber may be used to minimize adhesion and/or dissolve the material (an adhesive on a first nozzle and an adhesive activator on a second nozzle, for example) on each nozzle.

Typically, the holster is formed of stainless steel. However, it should be understood that any material may be used that is capable of holding the liquid in the reservoir and also capable of supporting the weight of the adhesive spray gun with minimal or no deformation. Such materials may include, but are not limited to: various metals and alloys, rigid plastics, composite materials, and the like.

The liquid stored in the reservoir may be any liquid capable of keeping the material in and on the nozzle (which is the material sprayed through the nozzle when in use) from drying out or otherwise hardening or thickening. In some further embodiments, the fluid may at least partially dissolve or break down this material (adhesive and activator, for example). In still a further embodiment, the fluid may be a water-based surfactant. Examples of which the liquid may be selected from include, but are not limited to: Water (preferably soft water or deionized water), Polyethoxylated tallow amines; Soaps of fatty acids such as water soluble tallates, laurates; Alkoxylated alcohols; Ethoxlated alcohols such as lauryl alcohol, decyl alcohol, C12-C18 alcohols; Ethoxylated phenols such as decyl phenol, dinonyl phenol, dodecyl phenol; Ethoxylated fatty acids such as laurate, stearate, oleate, tallate; Ethoxylated fatty amines such as tallow amine, tallow diamine, hydrogenated tallow amine, oleyl amine, stearyl amine, coco amine, coconut amine; Ethoxylated glycerides such as coconut glyceride, castor oil, hydrogenated castor oil; Phosphate esters based on various alcohols and phenols; Polyethylene glycolated esters; Polyoxyalkylene glycol ether; Sulfated alcohols; Sulfonated alcohols; Sulfonated castor oil; Alkyl carboxylates such as water soluble stearates, i.e. sodium stearate; Anionic surfactants such as Sodium Lauryl Sulfate, Sodium Lauryl Ether Sulfate; Anionic detergents such as alkyl sulfates, alkyl sulfonates, alkyl benzene sulfonates; Cationic detergents such as quaternary ammonium salts, fatty alcohols such as Lauryl Alcohol, Decyl Alcohol, C12-C18 alcohols; Nonionic detergents such as those based on polyoxyethylene; and Amphoteric surfactants such as imino acetates and imino propionates such as sodium octyliminodipropionate, among others.

Turning to the figures generally, particular embodiments of the spray gun holster are shown. These embodiments show the holster having a reservoir 10 that is attachable to a wall or other surface by at least one flange 11, 13. However, it should be understood that the holster may be positioned anywhere, and connected to a supporting structure in any manner. In one embodiment, the flange 11, 13 may swivel about a hinge relative to the reservoir body to provide flexibility in mounting location and surface. Two uprights 14 may protrude upward from the base reservoir 10 on the front of the holster to provide balance to the gun. Further, in some embodiments a cross bar 15 may extend upwards from a rear of the holster. In this embodiment, the spray gun may be hung on the cross bar 15 because many spray guns have a hanging hook on their top (See FIG. 4).

In some embodiments, mounting flanges 11, 13 extend away from the reservoir to provide a spacing between the reservoir and a wall, so that the rear of the reservoir is not flush with the wall. A drain 22 may be positioned on an underside of the reservoir body 10 to allow draining of the liquid 21 within the chamber 16. In use, the liquid 21 is filled to a level within the chamber 16 sufficient to cover the nozzle when the spray gun 41 is positioned in the holster with the nozzle in the reservoir chamber 16. The spray gun can be placed in the holster when not being used and, when ready, can be removed for spraying.

Figure 1:
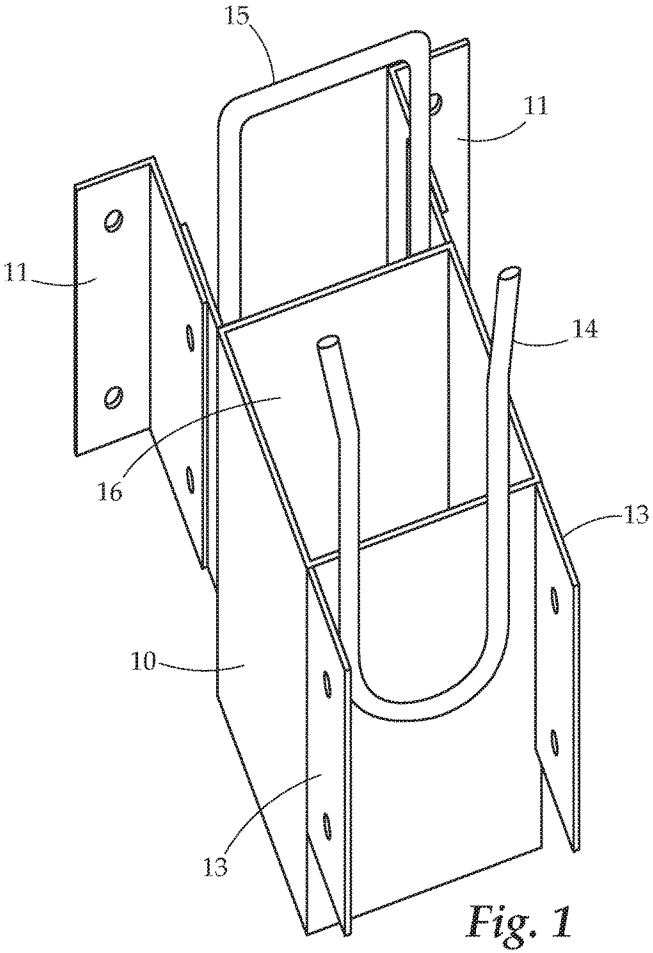
FIG. 1 provides a perspective view of one embodiment of the holster of the present invention.

Turning now to FIG. 1, a perspective view of a spray gun holster is provided. The holster forms a reservoir body 10. The reservoir 10 defines a chamber 16 in which at least a front portion of the spray gun (not shown) may be placed. Flanges 11, 13 may extend from a front 13 and rear 11 of the reservoir body 10. These flanges 11, 13 may be used to mount the holster to a wall or other structure. Uprights 14 are shown extending from a front of the reservoir body 10, though could also extend from sides or other portions. Uprights 14 function to hold the spray gun in position and to prevent it from falling to a left or right. Cross bar 15 extends from a rear of the reservoir body 10, though could also extend from sides or other portions. Cross bar 15 may function as a holder on which a spray gun having a top hook can be hooked onto. By hooking a spray gun to cross bar 15, the gun is held in position and prevented from falling at least forward or backwards and to some extent from falling side to side.

FIG. 2 provides a side cut away view of another embodiment of the holster. In this view, uprights 14 and cross bar 15 can be seen extending from a top of reservoir body 10. Flange 11 extends from a rear of the reservoir body 10. The chamber 16 contains a quantity of fluid 21. This fluid 21, as noted above, is selected to prevent a drying, thickening or hardening of the material in and on the nozzle of a spray gun to be placed into the holster. A drain valve 22 is positioned on a bottom of the reservoir 10, which slopes downwardly towards a front of the holster. The drain valve 22 allows for draining of the fluid when it is in need of replacement or when the chamber 16 is to be cleaned or not used. In this view, uprights 14 are shown to be higher than the cross bar 15, but that is not necessarily the case in varying embodiments.

Figure 3:
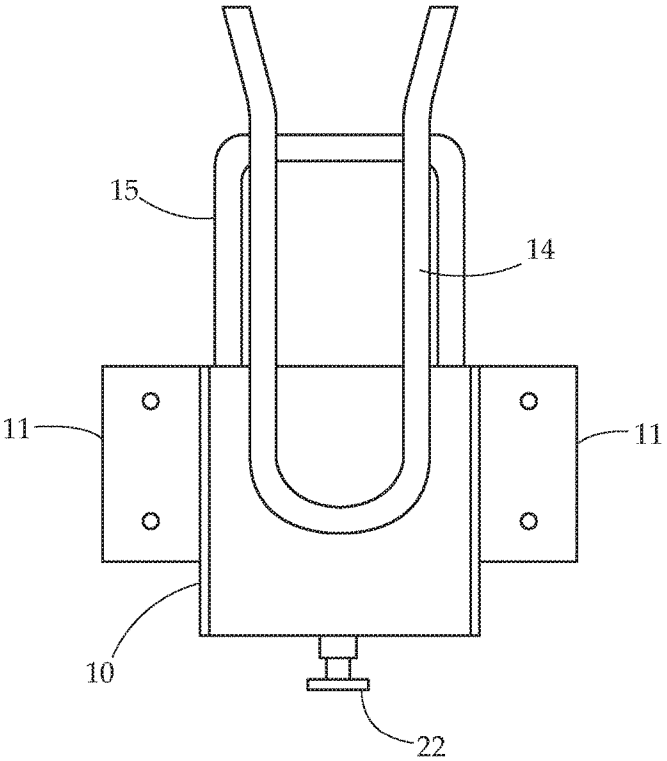
FIG. 3 provides a frontal view of another embodiment of the holster.

FIG. 3 provides a front view of another embodiment of the spray gun holster. In this view, uprights 14 and cross bar 15 can be seen extending from a top of reservoir body 10. Flanges 11 extend from sides of the holster reservoir body 10. Drain valve 22 is accessible on the bottom of the reservoir body 10.

Figure 4:
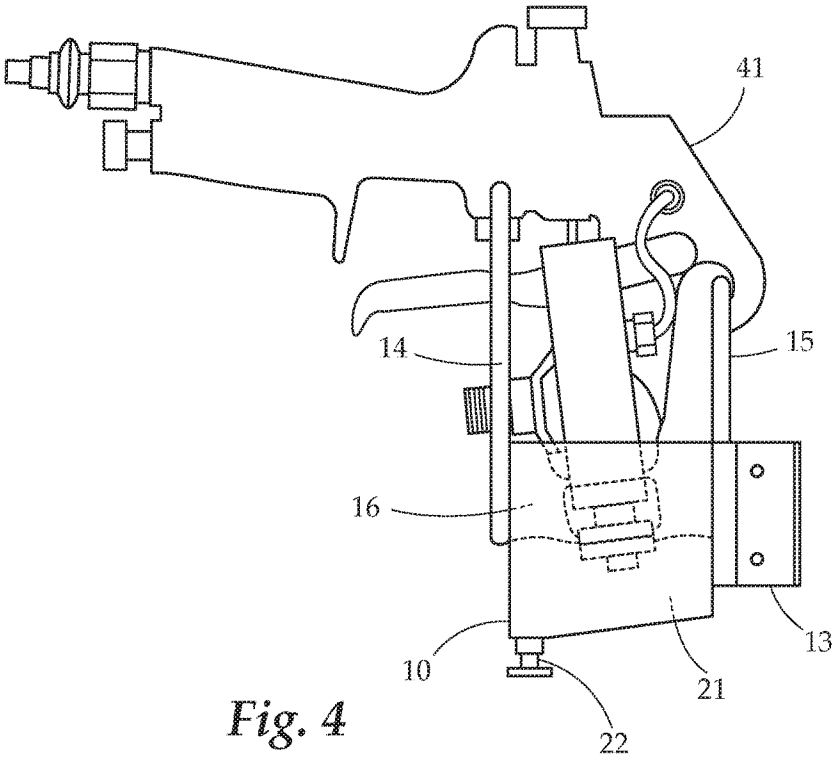
FIG. 4 provides a side cut away view of yet another embodiment of the holster.

FIG. 4 provides a view of an embodiment of the holster having a spray gun held therein. The spray gun 41 has a front portion with a nozzle. This nozzle is positioned within the chamber 16, and submerged in fluid 21. Fluid 21 prevents any excess material on or in the nozzle from hardening, thickening or drying, and in some embodiments may be selected to at least partially break down the material sprayed through the nozzle that may have collected on or in the nozzle. A hook on the top of the spray gun 41 is shown hooked to the cross bar 15, holding the spray gun 41 in place. Further, uprights 14 extend upwards from the reservoir body 10 over portions of the spray gun 41, to prevent the spray gun 41 from tilting to one side or the other.

Figure 5:
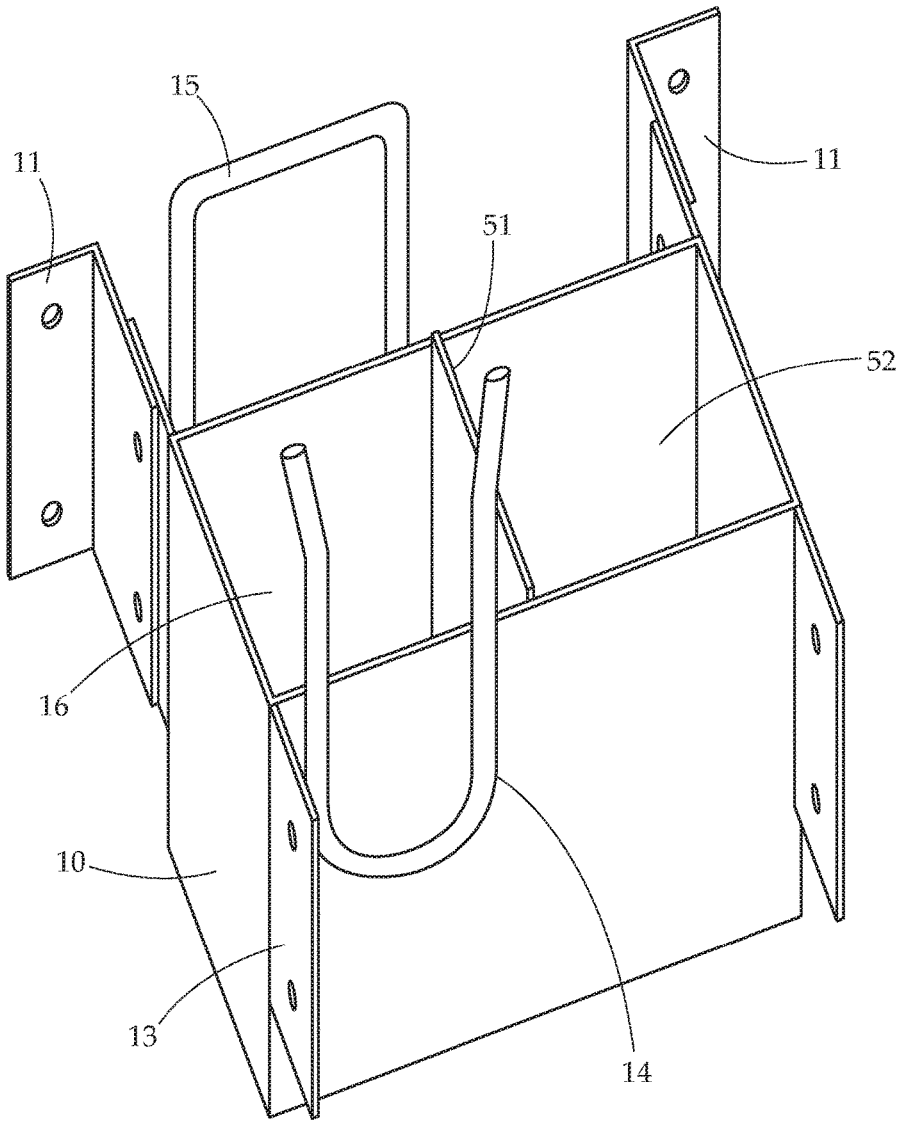
FIG. 5 provides a perspective view of still another embodiment of the holster.

FIG. 5 provides a view of an embodiment of the holster having two chambers which may be used for a spray gun having two spray nozzles. In this embodiment, one nozzle will sit in one chamber 16, and the other nozzle will sit in the other chamber 52. The holster forms a reservoir body 10. The reservoir 10 defines two chambers 16 and 52 in which at least a front portion of the spray gun (not shown) may be placed-typically having one nozzle in each chamber. Separator 51 extends between the front and rear walls of the body to form the two chambers 16, 52. Flanges 11, 13 may extend from a front 13 and rear 11 of the reservoir body 10. These flanges 11, 13 may be used to mount the holster to a wall or other structure. Uprights 14 are shown extending from a front of the reservoir body 10, though could also extend from sides or other portions. Depending on configuration of the two-nozzle spray gun, the uprights 14 may be placed in varying positions, such as to one side or in the center. Uprights 14 function to hold the spray gun in position and to prevent it from falling to a left or right. Cross bar 15 extends from a rear of the reservoir body 10, though could also extend from sides or other portions. Cross bar 15 may function as a holder on which a spray gun having a top hook can be hooked onto. By hooking a spray gun to cross bar 15, the gun is held in position and prevented from falling, at least forward or backwards and to some extent from falling side to side.

Figure 6:
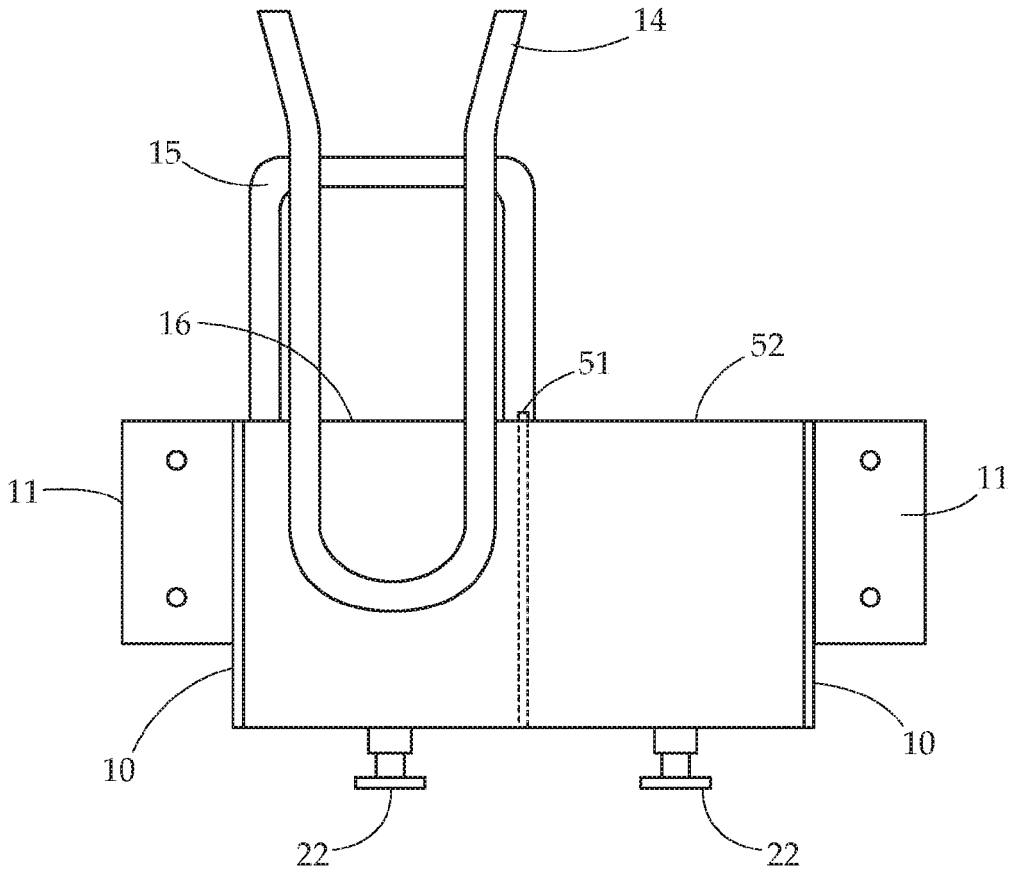
FIG. 6 provides a front view of yet still another embodiment of the holster of the present invention.

FIG. 6 provides a frontal view of another embodiment of the holster having two chambers. In this view, uprights 14 and cross bar 15 can be seen extending from a top of reservoir body 10. Flange 11 extends from sides of the reservoir body 10. Chambers 16 and 52 are separated by separator 51, and each contains a quantity of fluid. Depending on embodiment, the fluid in each chamber 16, 52 may be the same, or may be different. This fluid, as noted above, is selected to prevent a drying, thickening or hardening of the material in and on the nozzle of the spray gun to be placed into the holster. A drain valve 22 is positioned on a bottom of the reservoir body 10 for each chamber. The drain valve 22 allows for draining of the fluid when it is in need of replacement or when the chambers 16, 52 are to be cleaned or not used.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A holster for a spray gun comprising:

a reservoir body, the reservoir body defining a chamber within it, the chamber having an open top and sized to receive at least a portion of the spray gun;

two uprights extending from a front face of the reservoir body;

a cross bar extending from a rear face of the reservoir body; and wherein a lower portion of the chamber is capable of containing a quantity of fluid.

2. The holster of claim 1 further comprising a fluid positioned within the chamber.

3. The holster of claim 2 wherein the fluid is at least one of a detergent, a soap, an alcohol solution, and a surfactant.

4. The holster of claim 1 further comprising a second chamber formed by the reservoir body, the second chamber configured to receive a second nozzle of the spray gun.

5. The holster of claim 4 wherein the chamber is separated from the second chamber such that a fluid within the second chamber cannot pass to the first chamber.

6. The holster of claim 1 wherein a bottom surface of the chamber has a downward slope to urge fluid towards the rear face of the reservoir.

7. The holster of claim 1 further comprising a connecting structure configured to connect the reservoir body to an adjacent structure.

8. The holster of claim 1 wherein the two uprights are sized and configured to prevent a spray gun from falling towards a side of the holster when the spray gun is held in the holster.

9. The holster of claim 1 further comprising a drain spout at a bottom of the chamber providing a fluid outlet from the chamber.

10. The holster of claim 2 wherein the spray gun is an airless adhesive spray gun, and wherein the fluid is selected to prevent a hardening of an adhesive on a nozzle of the spray gun.

11. A spray gun holster system comprising:

a holster, the holster comprising:

a reservoir body, the reservoir body defining a chamber within it, the chamber having an open top;

an airless adhesive spray gun resting in the chamber with at least a nozzle positioned within the chamber;

a second chamber in the reservoir body, a second nozzle of the spray gun positioned within the second chamber; and a first quantity of fluid within the chamber, the fluid submerging the nozzle of the airless adhesive spray gun.

12. The spray gun holster system of claim 11 further comprising two uprights extending from a front face of the reservoir body.

13. The spray gun holster system of claim 11 further comprising a cross bar extending from a rear face of the reservoir, a top hook of the airless adhesive spray gun connected to the cross bar.

14. The spray gun holster system of claim 11 further comprising a drain spout at a bottom of the chamber providing a fluid outlet from the chamber.

15. The spray gun holster system of claim 11 further comprising a connecting structure configured to connect the reservoir body to an adjacent structure.

16. The spray gun holster system of claim 11 further comprising a second quantity of fluid within second chamber, the second nozzle submerged in the second quantity of fluid.

17. The spray gun holster system of claim 16 wherein the second quantity of fluid is different from the first quantity of fluid.

18. The spray gun holster system of claim 16 wherein the chamber is separated from the second chamber such that the second quantity of fluid within the second chamber cannot pass to the first chamber.

19. The spray gun holster system of claim 11 wherein a bottom surface of the chamber has a downward slope to urge fluid towards the rear face of the reservoir.

* * * * *